US010493318B2

(12) United States Patent
Ota

(10) Patent No.: US 10,493,318 B2
(45) Date of Patent: Dec. 3, 2019

(54) LOW-FLOOR TREADMILL

(71) Applicant: OHTAKE ROOT KOGYO CO., LTD., Ichinoseki-shi, Iwate (JP)

(72) Inventor: Yoshitake Ota, Ichinoseki (JP)

(73) Assignee: OHTAKE ROOT KOGYO CO., LTD., Ichinoseki-shi (JP)

( * ) Notice: Subject to any disclaimer, the term of this patent is extended or adjusted under 35 U.S.C. 154(b) by 303 days.

(21) Appl. No.: 15/474,308

(22) Filed: Mar. 30, 2017

(65) Prior Publication Data

US 2018/0214736 A1 Aug. 2, 2018

(30) Foreign Application Priority Data

Feb. 2, 2017 (JP) ..... 2017-017837

(51) Int. Cl.
*A63B 22/02* (2006.01)
*A63B 21/00* (2006.01)
*A63B 71/06* (2006.01)

(52) U.S. Cl.
CPC ..... *A63B 22/0285* (2013.01); *A63B 21/4035* (2015.10); *A63B 22/0235* (2013.01); *A63B 71/0619* (2013.01); *A63B 22/0207* (2015.10)

(58) Field of Classification Search
CPC ..... A63B 22/02–0264; A63B 22/0285
See application file for complete search history.

(56) References Cited

U.S. PATENT DOCUMENTS 6,607,469 B2 * 8/2003 Ota ..... A63B 22/0235 482/51
2005/0209060 A1 * 9/2005 Lull ..... A63B 22/0235 482/54

* cited by examiner

*Primary Examiner* — Jennifer M Deichl
(74) *Attorney, Agent, or Firm* — Sughrue Mion, PLLC

(57) ABSTRACT

[Problem] This invention provides a smaller size and space-saving low-floor treadmill which is improved in durability of support of the rea roller and which can prevent bending of the rear roller by using smaller sized roller in the rea roller for a moving belt of the low-floor treadmill.

[Means to Solve the problem] A low-floor treadmill having a running surface of a moving belt having a lower height from a floor, comprising the moving belt running in an endless manner between a front roller and a rea roller, the moving belt being driven by the front roller which is connected to a driving unit and being pressed down by a pressing roller to form a horizontal running surface, the moving belt being reversed after the rea end of the running surface at the rear roller positioned at a lower level from a floor, the moving belt being returned along the floor back to the front roller, characterized in that a plurality of bearings are arranged inside the rear roller and the bearings are fit in a coaxial spindle, and the rear roller is supported by said bearings to improve durability of the rea roller.

4 Claims, 6 Drawing Sheets

LOW-FLOOR TREADMILL

TECHNICAL FIELD

The present invention relates to an indoor exercise treadmill, in particular a low-floor treadmill or running machine having a low height from the floor surface for performing physical training or walking or running exercising.

BACKGROUND TECHNOLOGY

The low-floor treadmill or running machines are training installations used for performing physical training or walking or running exercising of patients in rehabilitation and of elderly people. In such low-floor treadmills, it is requested to lower a running surface in order to make the patient and elderly people in rehabilitation facilitate getting on and off the treadmill.

An example of known low-floor treadmill or running machine is disclosed in Patent Document 1 which is a previous invention of the present applicant.

In this running machine disclosed in Patent Document 1, a robust guide plate having a reduced friction is used to reduce a heavy load applied to the rear end of an endless belt located at an opposite side from a driving unit. However, the fixed guide plate has such a problem that friction increase comparing to a roller guide so that the guide plate exerts a bad influence on the durability of the moving belt and that a driving motor is overloaded.

Patent Document 2 proposes to use guide rollers arranged at an end of the endless belt in a low-floor treadmill. In this mechanism, however, it is necessary to use big bearings to support an axis of the guide roller, so that a larger space is required, resulting in such troubles that user trip on the treadmill and that the space is limited. Still more, it is difficult to design a smart treadmill.

LIST OF KNOWN DOCUMENTS

Patent Documents

[Patent document 1] JP-A1-2002-85586
[Patent document 2] JP-A1-2014-233578

SUMMARY OF INVENTION

Problems to be Solved by the Invention

The present invention was made in view of above problems and provides a smaller sized and space-saving low-floor treadmill which is improved in durability in support of the rea roller and which can prevent bending or deflection of the rear roller by using a smaller sized roller as the rea roller for a moving belt of the low-floor treadmill.

Means to Solve the Problems

In order to solve the above-mentioned problems, an invention defined in claim 1 provides a low-floor treadmill having a running surface of a moving belt having a lower height from a floor level, the treadmill comprising the moving belt running in an endless manner between a front roller and a rea roller, the moving belt being driven by the front roller which is connected to a driving unit and being pressed down by a pressing roller to form a running surface, the moving belt being reversed after the rea end of the running surface at the rear roller positioned at a lower level from the floor level, the moving belt being returned along the floor back to the front roller, characterized in that a plurality of bearings are arranged inside the rear roller and the bearings are fit in a coaxial spindle, and the rear roller is supported by said bearings to improve durability of the rea roller.

An invention of claim 2 is characterized in that a plurality of bearings are arranged at each side of the rear roller and the rear roller is supported on a rear roller spindle coaxially in the low-floor treadmill according to claim 1.

An invention of claim 3 is characterized in that a plurality of bearings are arranged at desired intervals through pacers and the rear roller is supported on a rear roller spindle coaxially in the low-floor treadmill according to claim 1.

An invention of claim 4 is characterized in that a rear roller supporting unit is arranged at a reverse side of the rear roller and is pressed against the rear roller to prevent bending or deflection of the rear roller in the low-floor treadmill according to any one of claims 1 to 3.

An invention of claim 5 is characterized in that the rear roller supporting unit comprises upper cam followers for supporting upper part of a side of the rear roller and lower cam followers for supporting lower part of the same side of the rear roller in the low-floor treadmill according to claim 4.

An invention of claim 6 is characterized in that a fixed support board is arranged beneath the moving belt, and that the support board comprises a surface layer made of plastic or silicon-coated wood and a core of veneer plywood or aluminum honeycomb structure beneath the surface layer, and metal plates being laminated on opposite surface of the core in the low-floor treadmill according to any one of claims 1 to 5.

Advantages of the Invention

In the invention of a treadmill defined in claim 1, a plurality of bearings are arranged inside the rear roller arranged at the rea end of the low-floor treadmill, the bearings are fit in a coaxial spindle and the rear roller is supported by the bearings. Therefore, durability of the rea roller can be improved.

The invention of a treadmill defined in claim 2 permits to prevent bending or deflection of the rea roller by a simple space-saving structure and to increase durability of the rea roller.

In the invention of a treadmill defined in claim 3, bending or deflection of the rea roller can be prevented effectively by positioning the bearings and spacers each having a predetermined length at locations where the bending is likely to occur.

In the invention of a treadmill defined in claims 4 and 5, bending or deflection of the rea roller can be prevented effectively by small-sized bearings, and durability of the rea roller can be improved by a space-saving structure.

In the invention of a treadmill defined in claim 6, the top layer of the support board is made of plastic or silicon-coated wood so that weight-reduction of the support board can be realized and frictional resistance of the moving belt can be reduced even the belt is pushed downward, resulting in that excessive load is not imposed to the driving unit.

MODE FOR CARRYING OUT THE INVENTION

[Mode for Carrying Out the Invention]

The object of the present invention can be realized by arranging or positioning a plurality of bearings inside the rear roller in the low-floor treadmill having a running surface whose height is 3.5 cm or less from a floor level, the rear roller having a diameter of 3.5 cm or less.

Hereafter, two Examples of the treadmill according to the present invention will be described with referring to attached drawings.

Example 1

Figure 1:
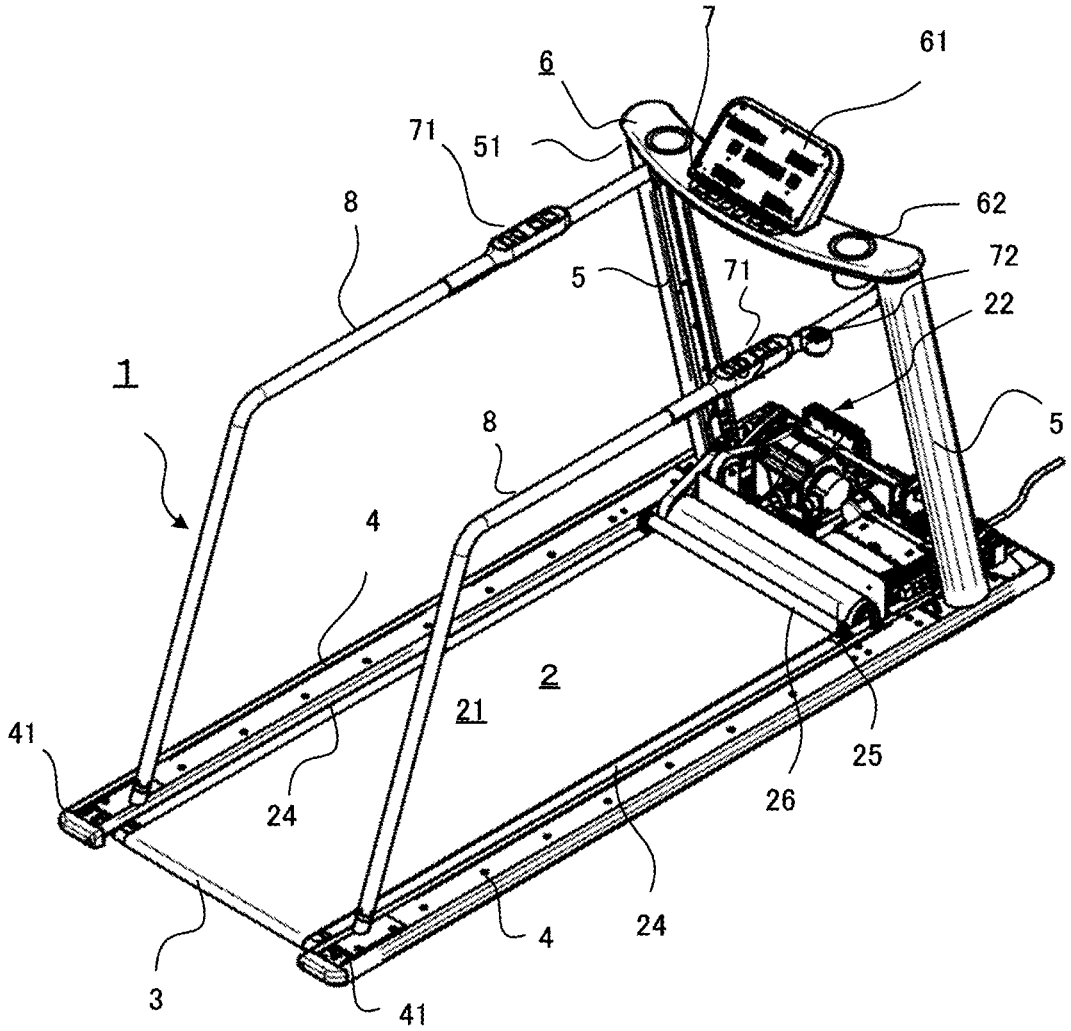
FIG. 1 A perspective view illustrating whole structure of a treadmill of Example 1 according to the present invention, here, a cover of a belt driving unit being removed.
Figure 2:
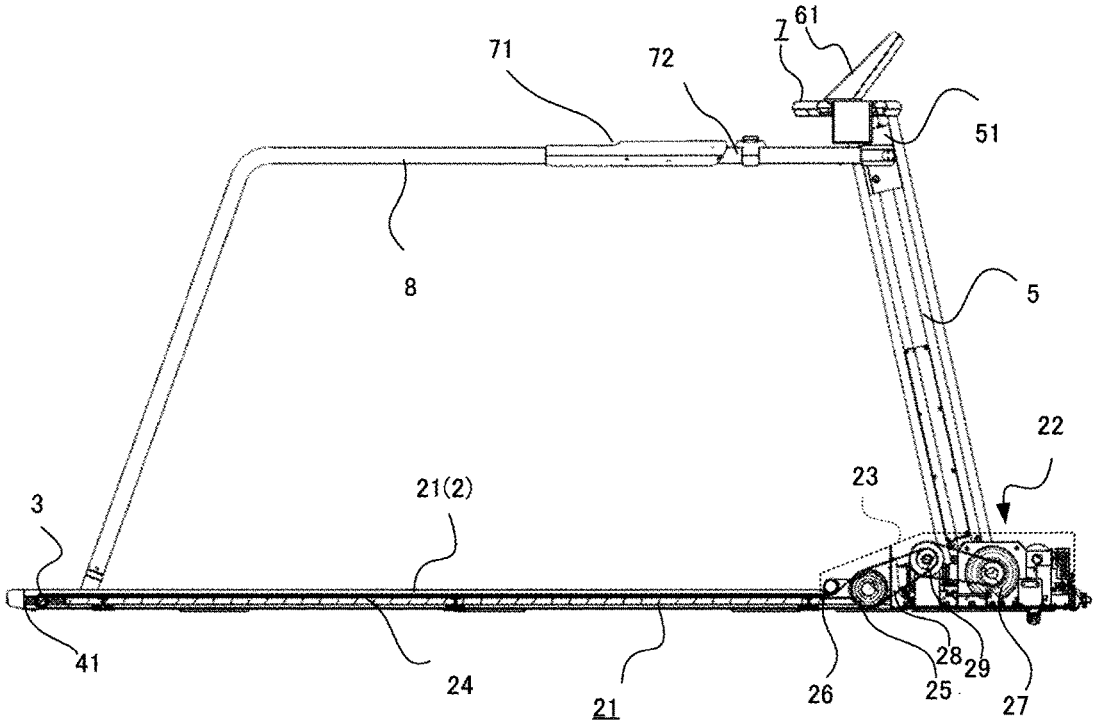
FIG. 2 A side-view of FIG. 1.

FIG. 1 is a perspective view of a low-floor treadmill 1 of Example 1 according to the present invention and is used mainly for training or medical diagnostics. The low-floor treadmill 1 has a running surface which is 3.5 cm or less in height from a floor level. FIG. 2 is a side view of the treadmill.

The low-floor treadmill 1 comprises a moving belt (2) which is an endless belt, a front roller (25) positioned at the front end of the treadmill 1 and around which the moving belt (2) is wound, a belt driving unit (22) for driving the front roller (25), a pressing roller (26) which press or guides the moving belt (2) to a low-floor level, and a rea roller (3) positioned at the rear end of the treadmill 1 for supporting or reversing the moving belt (2). A cover (23) of a belt driving unit (22) is not shown in FIG. 1. The treadmill 1 has also a pair of horizontal side frames (4) arranged along opposite sides of the moving belt (2), a pair of side column frames (5) extending upward at the front part of the treadmill 1 a top frame (6) bridging top ends (51) of the side column frames (5). A display unit (61) and a control board are secured to the top frame (6) at the center thereof and drink bottle holders are arranged at opposite sides of the display unit (61).

The treadmill 1 has also a pair of handrails (8) connecting respective top end (51) of the side column frame (5) to respective rear end (41) of the horizontal side frames (4). Handrail switches (71) are secured on respective handrails (8) and an emergency stop button (72) is arranged one of the handrails (8).

[Moving Belt]

Figure 3:
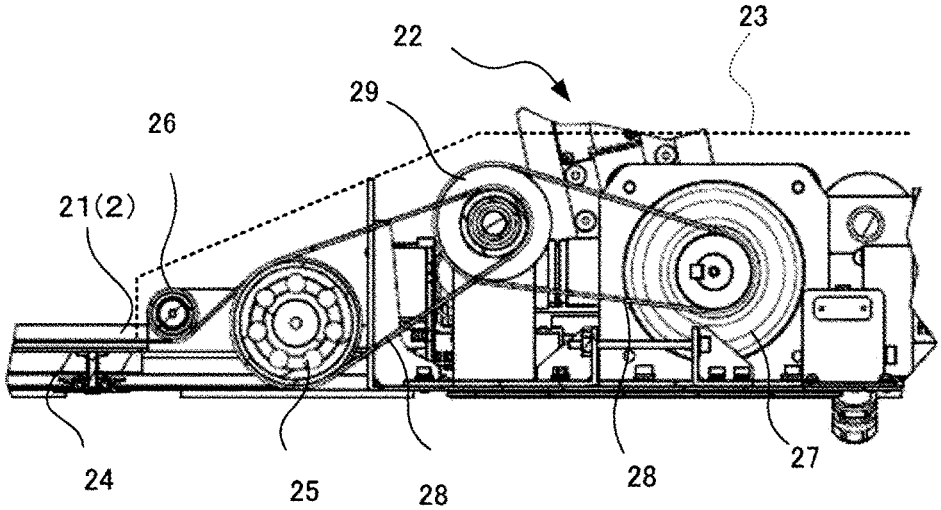
FIG. 3 A sectional side elevation of a belt driving unit of FIG. 1.

FIG. 3 illustrates a side view of the belt driving unit (22) shown in FIGS. 1 and 2. Here, the cover (23) of a belt driving unit (22) is removed and is shown in dotted line. The moving belt (2) or endless belt is driven by the front roller (25) and is pressed down by the pressing roller (26) to keep the running surface (21) of the moving belt (2) at a lower horizontal level, so that users can mount easily the running surface (21). Or, the low-floor running surface (21) according to the present invention makes the user facilitate to ride on the moving belt (2). A support board (2) is placed below the running surface (21) to prevent unnecessary sinking of the belt. The front roller (25) is driven by an intermediate pulley (29) which is driven by a driving motor through a timing belt (28).

In this Example, the height of an upper surface of the moving belt (2) can be 3.5 cm or less from a floor level by using the pressing roller (26), so that users lacking physical strength such as persons in rehabilitation can easily get on and off to the moving belt (2).

[Rear Roller 3]

Figure 4:
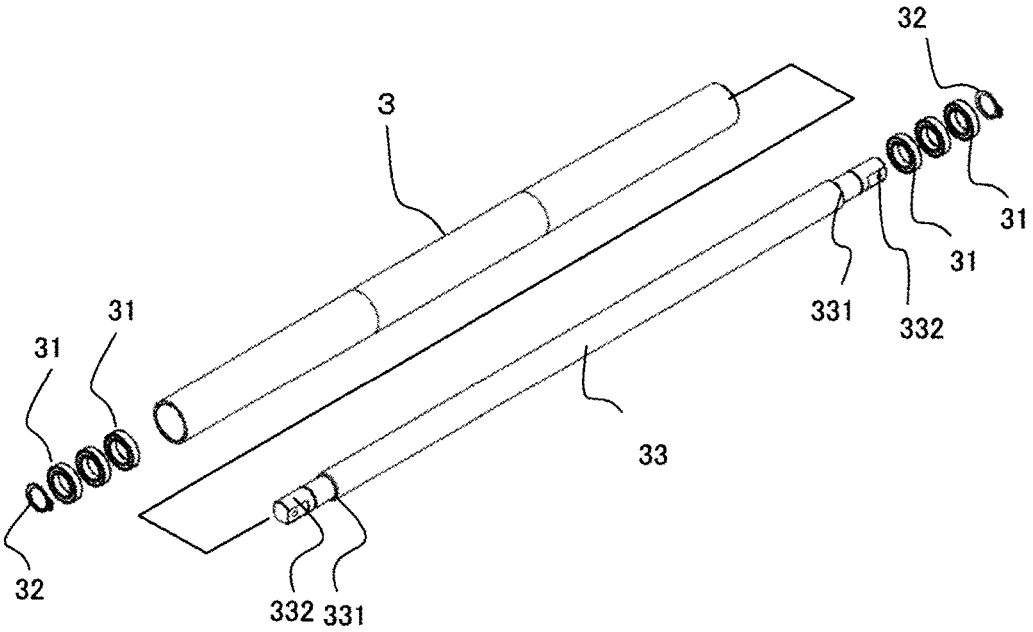
FIG. 4 Exploded perspective view of the rear roller according to Example 1.
Figure 5:
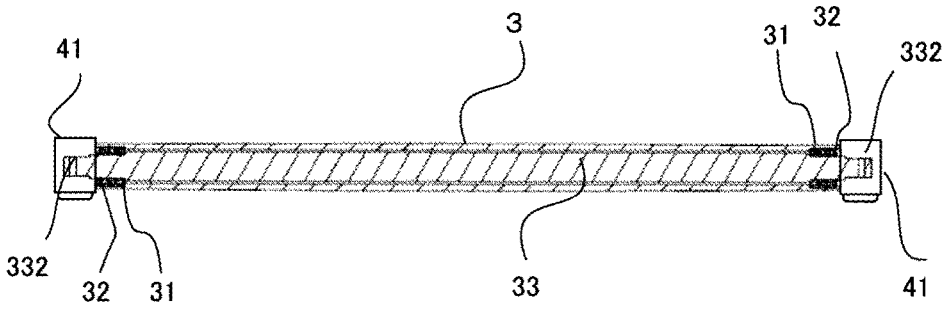
FIG. 5 A sectional view of assembled rear roller of FIG. 4.

FIG. 4 and FIG. 5 show the rear roller (3) positioned at the rear end of the treadmill 1 to reverse the moving belt (2). Since the running surface (21) is 3.5 cm or less, a diameter of the rear roller (3) must be naturally 3.5 cm or less (preferably 3 cm or less). In Example 1, a plurality bearings (three bearings in this case) (31) are fit on trimmed ends or steps (331) each formed on opposite ends of a rear roller spindle (33) which is then inserted into the rear roller (3). Outer end of the bearings (31) is fixed by a C type retaining ring (32), so that bearings (31) are supported securely on the rear roller spindle (33). The resulting assembly comprising rear roller spindle (33), bearings (331) and the rear roller (3) is secured to the horizontal side frames (4) through respective rear ends (41) as is shown in FIG. 5.

Thus, the rear roller (3) is supported by the inside bearings (31) according to the present invention, so that durability can be increased. Or, bending of the long rear roller (3) can be prevented by using bearings each having a smaller diameter. Still more, space-saving and smart design can be realized in comparison to the conventional structure in which rear roller spindle is supported by big bearings of larger diameters.

[Rear Roller Support Unit (34)]

Bending of the long rear roller (3) can be prevented by shifting or positioning the bearings (31) at suitable positions.

Figure 6:
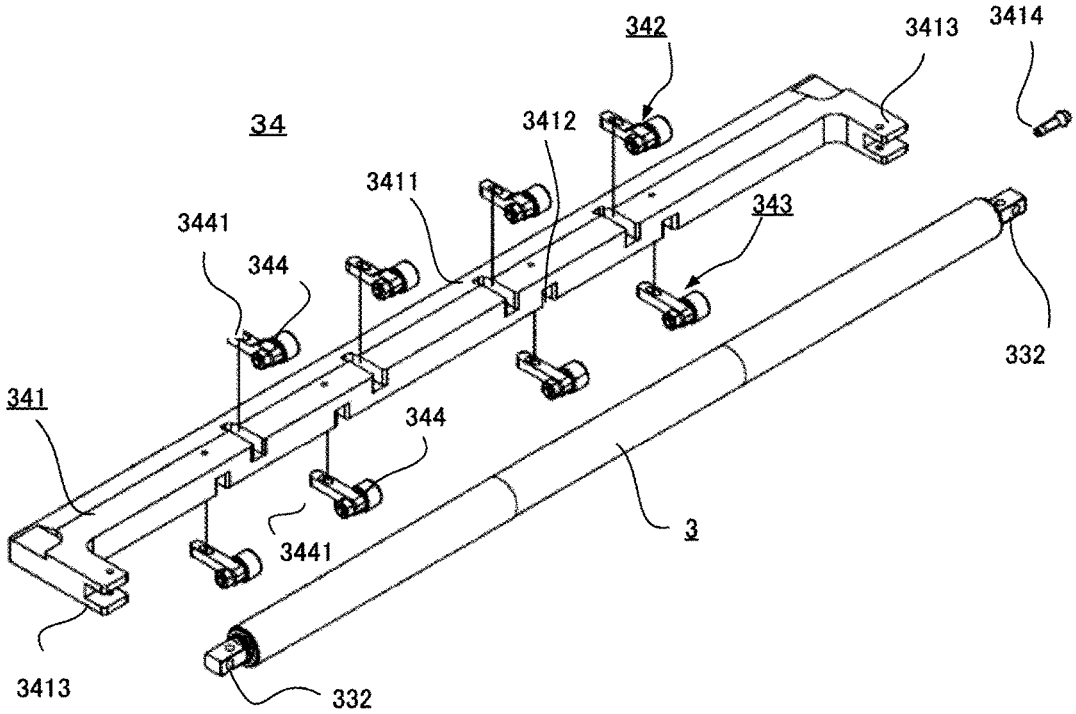
FIG. 6 Exploded perspective view of a rear roller support unit.
Figure 7:
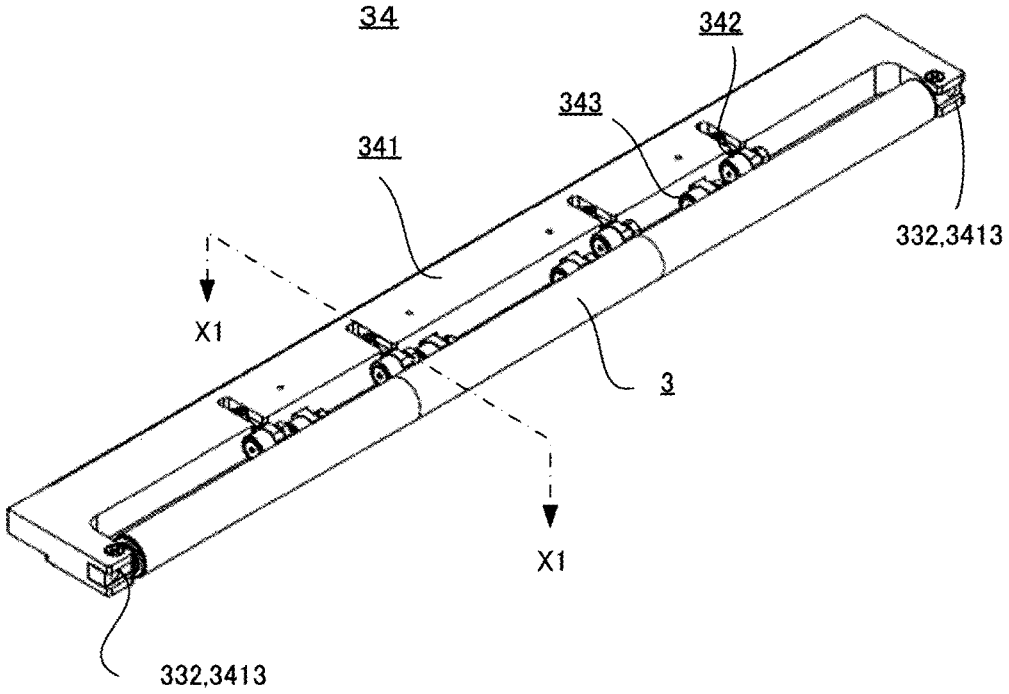
FIG. 7 A sectional view of assembled rear roller support unit of FIG. 6.
Figure 8:
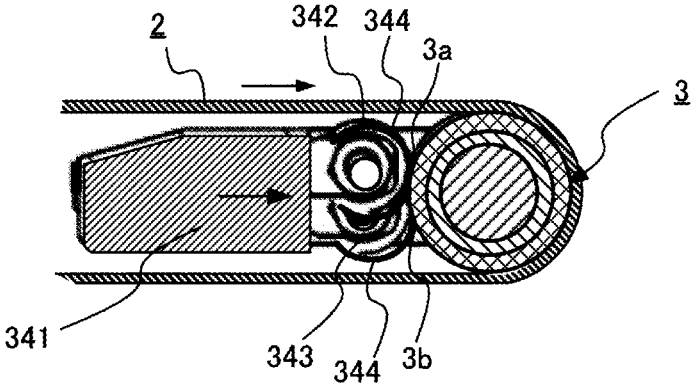
FIG. 8 A sectional view along a line X1-X1 of FIG. 7.

In FIG. 6 and FIG. 7, bending of the long rear roller (3) is prevented by a rear roller support unit (34) which is a mechanism to push back the rear roller (3).

The rear roller support unit (34) comprises a plurality upper cam followers (four, in this case) (342) which support or receive an upper part (3*a*) of a side of the rear roller (3) and a plurality lower cam followers (four, in this case) (343) which support or receive a lower part (3*b*) of the same side of the rear roller (3). Two type cam followers (342, 343) are arranged at an upper side and a lower side of the rear roller (3), so that the cam followers do not run off the rear roller (3).

In practice, each upper cam follower (342) comprises a small roller (344) which is supported by a supporting stem (3441). The rear roller support unit (34) has a supporting frame (341). The supporting stem (3441) is received in and secured to an upper fitting recess (3411) which is formed on an upper part of the supporting frame (341). In this case, the supporting frame (341) has four upper fitting recesses (3411). In the same manner, four lower fitting recesses (3411) are formed on a lower part of the supporting frame (341) and the supporting stem (3441) is received in and secured to a lower fitting recess (3422) which is formed on a lower part of the supporting frame (341). The lower fitting recesses (3422) are formed at different positions or sifted from the upper fitting recesses (3411) along the supporting frame (341).

FIG. 7 is an illustration of the rear roller support unit (34) assembled and FIG. 6 is a cross section of a part of the roller support unit (34) along a line X1-X1 in FIG. 7. The rear roller support unit (34) is secured to opposite spindle supports (332) of the rear roller spindle (33) by fixing screws (3414) in such a manner that a correct position of the rear roller (3) is kept by the small rollers (344).

Thus, the upper cam followers (342) and the lower cam followers (343) push back the rear roller (3) to its initial straight-line position from a bulging direction.

[Support Board (24)]

Since a height of the running surface (21) is 3.5 cm or less from floor level, a support board (24) which is arranged between an upper half and a lower half of the moving belt (2) must have a height or width which is fairly thin and less than 3.5 cm. In this example, the height or width of the running surface (21) is less than 20 mm (for example 16.6 mm).

Figure 9:
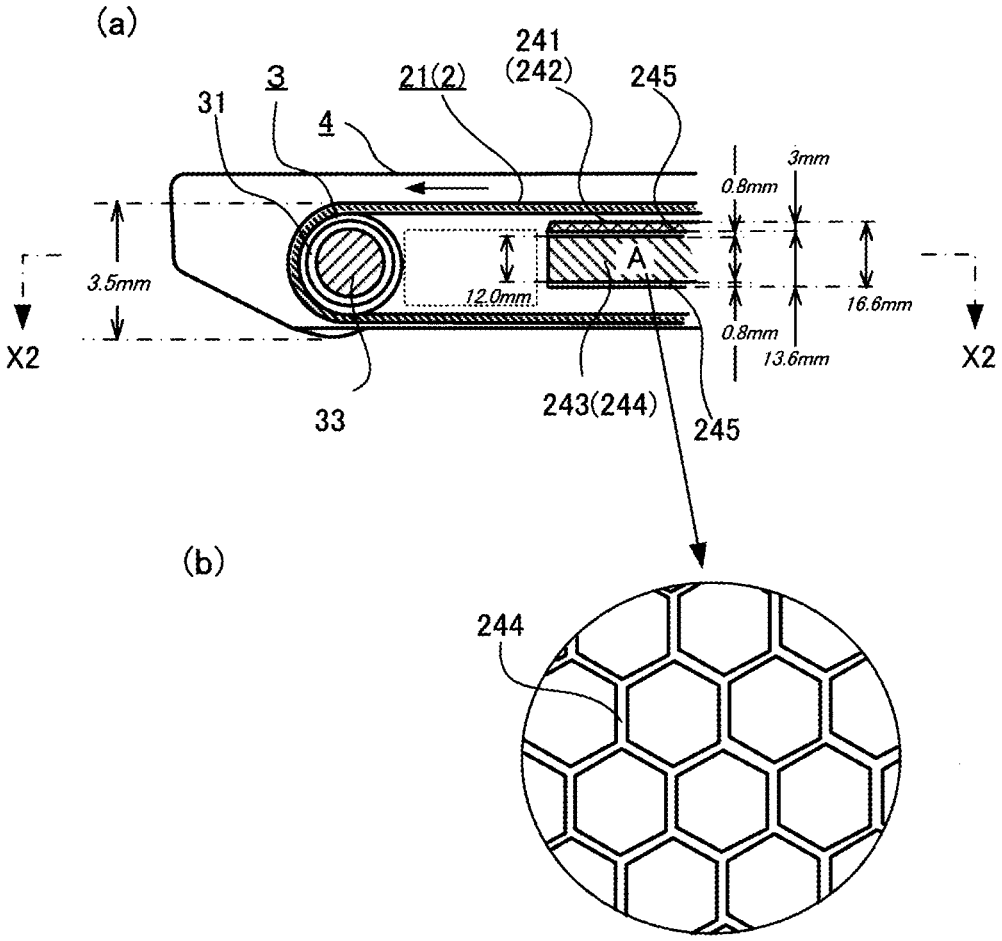
FIG. 9 (a) is a sectional side elevation showing a support board beneath the moving belt and (b) is an enlarged sectional view of part A along a line X2-X2 in (a).

As shown in (a) of FIG. 9, the support board (24) arranged beneath the running surface (21) of the moving belt (2) has a core of veneer plywood (243) consisting of a plurality of alternate woody texture layers or an aluminum honeycomb structure (244) having a laminated surface metal plate (245) having a thickness of about 0.8 mm. (b) in FIG. 9 shows a cross sectional view of the honeycomb structure (244) along a line of X2-X2 in (a) of FIG. 9. Walls of the honeycomb structure (244) extend vertically. A plastic (241) or a silicone-coated timber sheet (242) is laminated on the top of the core.

Owing to the above structure, the support board (24) is lightweight and robust and frictional resistance of the moving belt can be reduced even the belt is pushed downward, so that excessive load is not imposed to the driving unit.

Example 2

[Rear Roller (3)]

Figure 10:
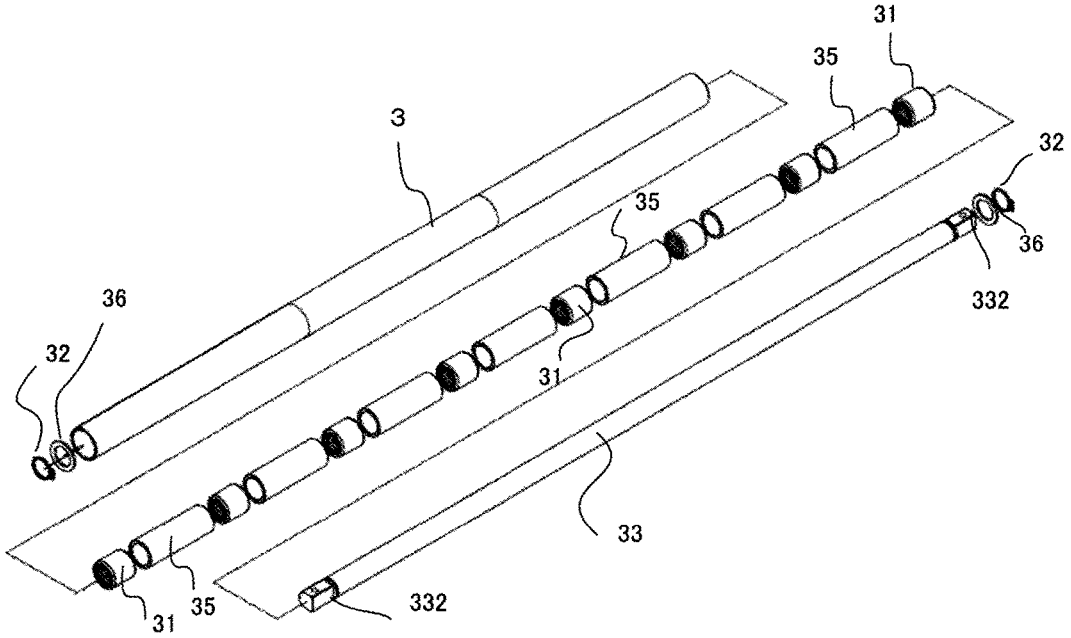
FIG. 10 Exploded perspective view of the rear roller of Example 2.
Figure 11:
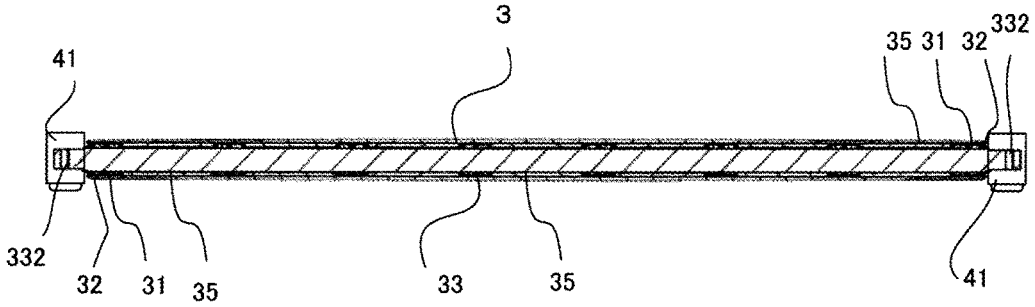
FIG. 11 A sectional view of assembled rear roller of FIG. 10.

In Example 1, the rear roller (3) has a plurality of bearings at opposite ends of the low-floor treadmill. In this Example 2, as is shown in FIG. 10 and FIG. 11, a plurality of bearings are arranged at predetermined locations through spacer sleeve (35) inside the rear roller (3) along the long rear roller (3) to prevent bending of the rear roller (3).

For further details, in Example 2, an assembly of eight bearings (31) and seven spacer sleeves (35) having a predetermined length are arranged alternately along the long rear roller (3) and the rear roller spindle (33) inserted into the assembly. Then, the resulting assembly is inserted into the rear roller (3). Finally, a washer (36) is inserted onto respective end of the rear roller spindle (33) and then C type retaining ring (32) is fixed at respective opposite ends of the assembly so that the resulting assembly does not come off the rear roller spindle (33). Finally, the above-mentioned rear roller support unit (34) is secured to opposite spindle supports (332) in the same manner as Example 1.

Although the spacer sleeves (35) are arranged at equal interval and hence an interval of adjacent bearings (31) is uniform in this Example 2, it is not necessary to arrange them at equal distance but the interval can be adjusted according to bending load imposed.

In Example 2, bearings can be arranged at desired location where bending is apt to occur by using suitable spacer sleeve having a predetermined length, to prevent bending of the rear roller.

Effect and Advantage

As mentioned above, in Examples 1 and 2 according to the present invention, a plurality of bearings can be installed inside a hollow rear roller positioned at a rear end of a moving belt of a low-floor treadmill and are supported by a coaxial rear roller spindle, so that bending of the rear roller is prevented effectively and endurance or durability can be improved with space-saving.

Moreover, prevention of bending of rear roller can be realized by a simple structure, as well as endurance or durability can be improved with space-saving manner. Bending of the rear roller can be prevented more effectively by using spacer sleeves having a predetermined length. Bending of the rear roller can be prevented effectively by means of small sized bearings since the rear roller supporting unit according to the present invention is used, so that long durability can be realized with space-saving.

Furthermore, frictional resistance can be reduced even when the belt is pushed downward by feet, since the top surface of a thin support board is covered by a plastic layer or silicone-coated timber (242). Sufficient strength is assured for the thin support board by using a core made of veneer plywood (243) consisting of a plurality of alternate woody texture layers or an aluminum honeycomb structure (244) having vertical walls.

REFERENCE NUMBER

1 Treadmill
2 Moving belt
21 Running surface
22 Belt driving unit
23 Cover
24 Support board
241 Plastic layer
242 Silicone-coated timber
243 Veneer plywood
244 Aluminum honeycomb structure
245 Metal plate
25 Front roller
26 Pressing roller
27 Driving motor
28 Timing belt
29 Intermediate pulley
3 Rear roller
3*a* Upper side of roller
3*b* Lower side of roller
31 Bearings
32 C type retaining ring
33 Rear roller spindle
331 Step for fixing bearings
332 Spindle support
34 Rear roller supporting unit
341 Supporting frame
3411 Upper fitting recess
3412 Lower fitting recess
3413 Attaching part
3414 Fixing screw
342 Cam follower for supporting upper part
343 Cam follower for supporting lower part
344 Small roller
3441 Supporting part
35 Spacer
36 Washer
4 Horizontal side frame
41 Rear end

5 Side column
51 Upper part
6 Top frame
61 Display unit
62 Drink holder
7 Control part
71 Handrail switch
72 Emergency stop button
8 Handrail

The invention claimed is:

1. A low-floor treadmill having a running surface of a moving belt comprising:

the moving belt running in an endless manner between a front roller and a rear roller, the moving belt being driven by the front roller which is connected to a driving unit and being pressed down by a pressing roller to form the running surface, the moving belt being reversed at a rear end of the running surface of the rear roller and having a height of 3.5 cm or less from a floor level, the moving belt being returned along the floor back to the front roller, wherein a plurality of bearings are arranged inside the rear roller and the bearings are fit on a coaxial spindle, and the rear roller is supported by said bearings to improve durability of the rear roller wherein a rear roller supporting unit is arranged at a reverse side of the rear roller and is pressed against the rear roller to prevent deflection of the rear roller, and wherein said rear roller supporting unit comprises upper cam followers for receiving an upper part of a side of the rear roller and lower cam followers for receiving a lower part of the side of the rear roller.

2. The low-floor treadmill according to claim 1, wherein the rear roller is supported coaxially on the rear roller spindle which supports the plurality of bearings which are arranged between opposite sides of the rear roller.

3. The low-floor treadmill according to claim 1, wherein the rear roller is supported coaxially on the rear roller spindle which supports the plurality of bearings which are arranged between opposite sides of the rear roller.

4. The low-floor treadmill according to claim 1, further comprising a fixed support board is-arranged beneath the moving belt, said fixed support board comprising a surface layer of plastic or silicon-coated wood, a core of veneer plywood or an aluminum honeycomb structure beneath the surface layer, and metal plates being laminated on opposite surfaces of the core.

* * * * *